US005416751A

United States Patent [19]

Imahori et al.

[11] Patent Number: 5,416,751

[45] Date of Patent: May 16, 1995

[54] ELECTROACOUSTIC TRANSDUCER

[75] Inventors: Yoshio Imahori; Isao Fushimi; Katsutoshi Nito, all of Shizuoka, Japan

[73] Assignee: Star Micronics Co., Ltd., Shizuoka, Japan

[21] Appl. No.: 151,822

[22] Filed: Nov. 15, 1993

[30] Foreign Application Priority Data

Nov. 18, 1992 [JP] Japan ..... 4-332546

[51] Int. Cl.[6] ..... H04R 25/00

[52] U.S. Cl. ..... 367/175; 381/192; 381/193; 381/202

[58] Field of Search ..... 367/175, 185; 381/192, 381/193, 202, 194

[56] References Cited

U.S. PATENT DOCUMENTS

| | | | |
|---|---|---|---|
| 2,490,227 | 12/1949 | Murkham | 179/115.5 |
| 4,399,334 | 8/1983 | Kakiuchi et al. | 178/180 |
| 4,803,733 | 2/1989 | Carver et al. | 381/193 |
| 5,150,419 | 9/1992 | Kizak et al. | 381/194 |

FOREIGN PATENT DOCUMENTS

| | | |
|---|---|---|
| 57-28478 | 6/1957 | Japan . |
| 59-159098 | 10/1984 | Japan . |
| 60-26099 | 2/1985 | Japan . |

*Primary Examiner*—J. Woodrow Eldred
*Attorney, Agent, or Firm*—Pollock, Vande Sande & Priddy

[57] ABSTRACT

An electroacoustic transducer converts an electric signal into sound by vibrating a diaphragm magnetically in response to the electric signal input thereto. A movement restricting means for restricting the movement of the diaphragm within an allowable movement range is provided on the inner wall of a resonant chamber disposed at one side of the diaphragm. The restricting means normally confronts at a magnetic member attached to the center of the diaphragm. The restriction means contacts the magnetic member when the diaphragm attempts a deflection beyond the allowable range.

12 Claims, 13 Drawing Sheets

ELECTROACOUSTIC TRANSDUCER

BACKGROUND OF THE INVENTION

1. Field of the Invention

The present invention relates to an electroacoustic transducer for converting an electric signal input thereto into sound.

2. Description of the Prior Art

An electroacoustic transducer is a means for converting an electric signal input thereto into sound. The electroacoustic transducer will produce an acoustic output in response to an input electric signal. Accordingly, the electroacoustic transducer can be employed by electronic devices, etc. as a sounding means such as a buzzer.

A prior art electromagnetic type electroacoustic transducer is shown in FIGS. 17–21 and includes a cylindrical outer casing 102 which is formed of synthetic resins and houses a magnetic driving portion 104 at the rear side thereof. Input terminals 106 and 108 are formed in the magnetic driving portion 104 for inputting an electric signal to the magnetic driving portion 104. The magnetic driving portion 104 has a columnar core 110 at the center thereof and a coil 114 is wound around the core 110 by way of a bobbin 112. The input terminals 106 and 108 are connected to the ends of the coil 114 which is energized in response to the electric signal input thereto by way of the input terminals 106 and 108. A cylindrical magnet 116 is provided on the inner wall of the cylindrical outer casing 102 and disposed about the coil 114.

A diaphragm 118, which is driven by the magnetic driving portion 104, is provided on the peripheral edge of the cylindrical magnet 116 and it is formed of an elastic thin magnetic member. Accordingly, the diaphragm 118 is attracted by the cylindrical magnet 116 and forms a closed magnetic circuit together with the core 110 and the cylindrical magnet 116. A magnetic piece 120 is attached to the center of the diaphragm 118 to establish a close magnetic relation with the core 110 and to add mass to the diaphragm 118.

At the front side of the diaphragm 118, there are provided a resonant chamber 122 which is closed by the cylindrical outer casing 102 and serves as a resonant space and a sound emitting cylinder 124 which permits the resonant chamber 122 to be open to the atmosphere. A plurality of ribs 126 for restricting the movement of the diaphragm 118 within an allowable moving range are provided on the wall surface of the resonant chamber 122 at the edge of the diaphragm 118.

FIG. 18 is an enlarged cross-sectional view of the diaphragm 118. The diaphragm 118 is formed of a very thin plate member and the disk-like magnetic piece 120 is attached to the center thereof as a rigid member to add mass to the diaphragm 118. The center of the magnetic piece 120 is attached to the center of the diaphragm 118 by spot welding. Denoted at 127 shows the welded portion.

It is necessary to sufficiently reduce the size of the welded portion 127 without deterioration of the characteristics of the diaphragm 118 so as to stabilize and make uniform the electroacoustic conversion characteristics. Furthermore, it is necessary that the deformation or deterioration of the characteristics of the diaphragm 118 is lessened after the diaphragm 118 and magnetic piece 120 are spot-welded and that they are brought into close contact with each other so as to have stable elasticity as a vibrating member. It is still necessary that the diaphragm 118 is very thin to assure a necessary sound pressure and sounding bandwidth.

If the sound pressure or the sounding bandwidth is increased, bonding strength between the diaphragm 118 and the magnetic piece 120 is decreased, which results in deterioration of reliability and stability of the electroacoustic transducer.

Meanwhile, such an electroacoustic transducer is provided in a variety of portable electronic devices and is subject to an external force such as a strong vibration, shock, etc. FIG. 19 shows the stationary state of the diaphragm 118 and FIG. 20 shows the vibrating state of the diaphragm 18 when it is normally driven. In FIG. 20, (*a*) shows the movement of the diaphragm 118 toward the core 110 and (*b*) shows the movement of the diaphragm 118 toward the sound emitting cylinder 124. That is, the diaphragm 118 repeats a vibration to thereby emit a sound depending on the frequency of the input electric signal. Normally, rated input and limited input level corresponding to the allowable moving range are set so that the diaphragm 118 is prevented from moving beyond the allowable moving range.

When an external force such as a shock, etc. is applied to the electroacoustic transducer, the diaphragm 118 is liable to be deformed beyond the allowable moving range as illustrated in FIG. 21. FIG. 21(*a*) shows the movement of the diaphragm 118 toward the core 110 wherein the diaphragm 118 contacts the head of the core 110. That is, the diaphragm 118 is prevented from moving excessively due to the core 110 so that the diaphragm 118 is protected by the core 110.

In the case as illustrated in FIG. 21(*b*) where an external force is applied to the electroacoustic transducer so as to push the diaphragm 118 upward toward the sound emitting cylinder 124, a stress is applied between the diaphragm 118 and the magnetic piece 120 in such a manner to tear the magnetic piece 120 from the diaphragm 118. As a result, there is a possibility that the diaphragm 118 is broken or deformed at the welded portion 127 or its peripheral portion. In case that the external force is strong, there is a possibility that the magnetic piece 120 falls out from the diaphragm 118.

There are measures for protecting the diaphragm 118 from the external shock as disclosed in Japanese Utility Model Publication No. 57-28478 entitled Electromagnetic Type Electroacoustic Transducer for Wristwatch, in Japanese Utility Model Laid-Open Publication No. 59-159098 entitled Electromagnetic Type Electroacoustic Transducer and in Japanese Utility Model Laid-Open Publication No. 60-26099 entitled Electromagnetic Type Sounder, etc. However, there are the following problems. In Japanese Utility Model Publication No. 57-28478, it is difficult to assure a resonant effect since a space in front of the diaphragm is sacrificed so as to prevent an excessive vibration. In Japanese Utility Model Laid-Open Publication No. 59-159098 and also in Japanese Utility Model Laid-Open Publication No. 60-26099, there remains a possibility that the magnetic piece falls out by the shock because the magnetic piece is not restricted in vibration.

SUMMARY OF THE INVENTION

Accordingly, it is an object of the invention to provide an electroacoustic transducer that prevents a diaphragm from excessively moving at the center thereof beyond an allowable moving range and that protects the diaphragm from an external force such as a shock without sacrificing a resonant space.

That is, the electroacoustic transducer of the invention converts an electric signal to sound by vibrating the diaphragm (18) magnetically in response to the input electric signal. As illustrated in FIGS. 1 to 16, movement restricting means include sound emitting cylinder 24, projections 34, 36 and 38, are disposed at one side of the diaphragm (18) for restricting the movement of the diaphragm (18) within the allowable moving range of a magnetic piece (20) attached to the center of the diaphragm (18).

Although a variety of shapes and positions of the movement restricting means are conceived, a single or a plurality of projections (34, 36 and 38) for defining the allowable moving range are provided on the inner wall of the resonant chamber (22).

A sound emitting cylinder (24) for permitting the resonant chamber (22) to be open to the atmosphere can also serve as the movement restricting means.

According to the electroacoustic transducer of the invention, it is possible to prevent the generation of peeling force between the diaphragm and the magnetic piece and also prevent deformation, etc., of the diaphragm with assurance even if the shock is applied to the diaphragm (18) since the diaphragm (18) is restricted within the allowable moving range at the magnetic piece (20), i.e., at its central portion. If the movement restricting means is composed of a single projection or a plurality of projections, the resonant space can be less occupied by the movement restricting means, which enhances acoustic characteristics. If the sound emitting cylinder (24) serves also as the movement restricting means, it is not necessary to provide additional projections etc., to thereby simplify its structure.

The electroacoustic transducer of the invention has the following features:

(a) It is possible to protect the diaphragm against the damage or deformation caused by the shock etc. and to enhance the reliability of the electroacoustic transducer since the excessive movement of the diaphragm due to shock, etc., can be mechanically restricted at its central portion.

(b) It is possible to surely prevent a welded portion from being broken and prevent the diaphragm and the magnetic piece from being peeled from each other by an external force.

(c) It is possible to prevent deterioration of the characteristics of the diaphragm because the excessive movement of the diaphragm is restricted at the magnetic piece without directly contacting the diaphragm.

(d) The electroacoustic transducer of the invention realizes miniaturized construction, comparatively low-frequency sound output, high quality and high reliability. Furthermore, the diaphragm can be thinner and the magnetic piece can be heavier due to the restriction of movement of the diaphragm while the reliability of the welded portion is enhanced.

Other objects and features of the invention will be more apparent from embodiments as set forth hereinafter.

DETAILED DESCRIPTION OF THE PREFERRED EMBODIMENT

An electroacoustic transducer according to first to eighth embodiments will be described with reference to FIGS. 1 to 16.

Figure 1:
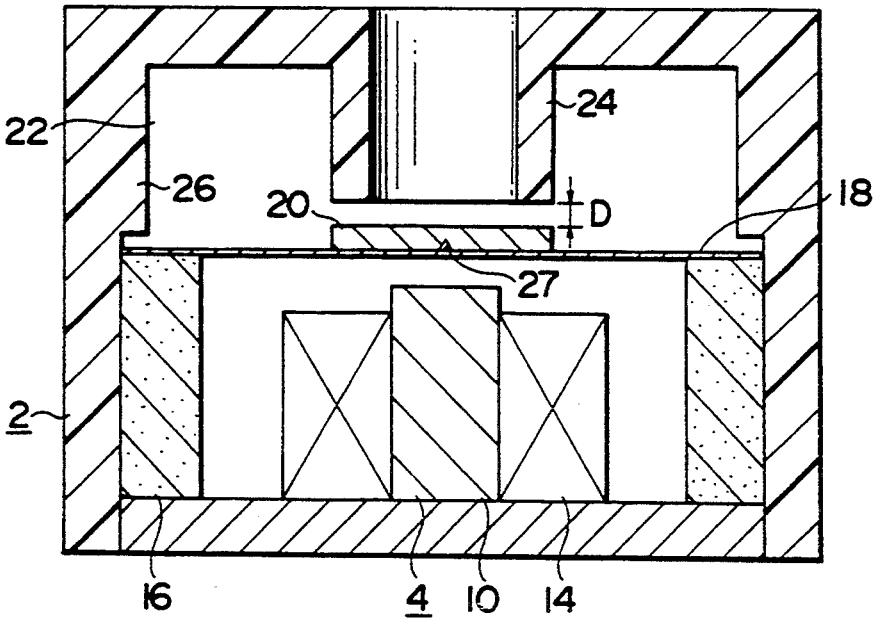
FIG. 1 is a longitudinal cross-sectional view of the electroacoustic transducer according to a first embodiment of the invention.
Figure 2:
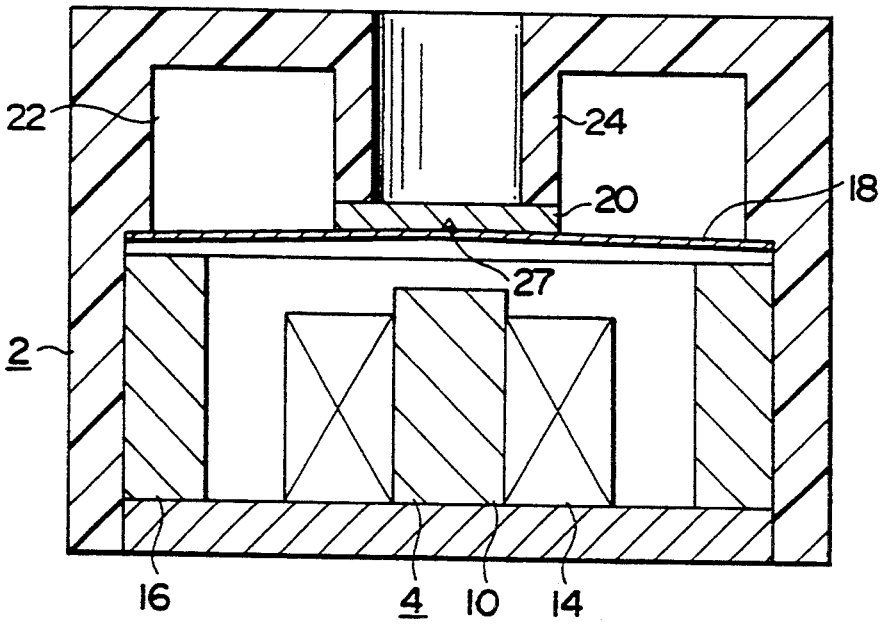
FIG. 2 is a longitudinal cross-sectional view showing the movement of a diaphragm when an external force is applied to the electroacoustic transducer of FIG. 1.

First Embodiment (FIGS. 1 and 2)

FIGS. 1 and 2 show the electroacoustic transducer according to the first embodiment of the invention.

A cylindrical outer casing 2 formed of synthetic resins houses a diaphragm 18, a magnetic driving portion 4 disposed at the rear side of the diaphragm 18 for vibrating the diaphragm 18 in response to an input electric signal and a resonant chamber 22 disposed at the front side (upper side in these figures) of the diaphragm 18 for serving as a resonant space. A sound emitting cylinder 24 is disposed in the resonant chamber 22 for permitting the resonant chamber to be open to the atmosphere.

Figure 17:
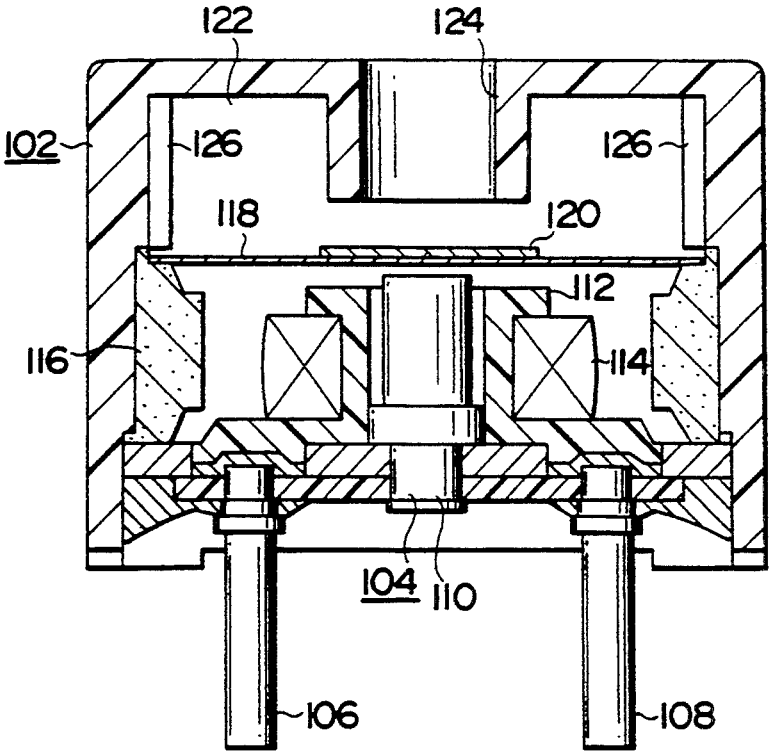
PRIOR ART FIG 17
FIG. 17 is a longitudinal cross-sectional view of a prior art electroacoustic transducer.
Figure 18:
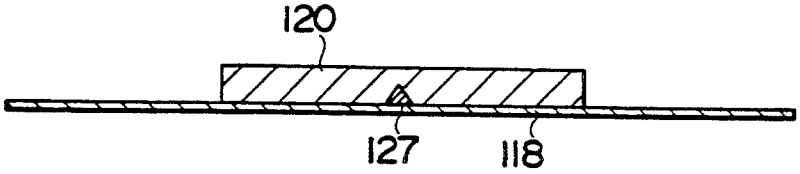
PRIOR ART FIG. 18
FIG. 18 is a cross-sectional view of a diaphragm of the electroacoustic transducer of FIG. 17.
Figure 19:
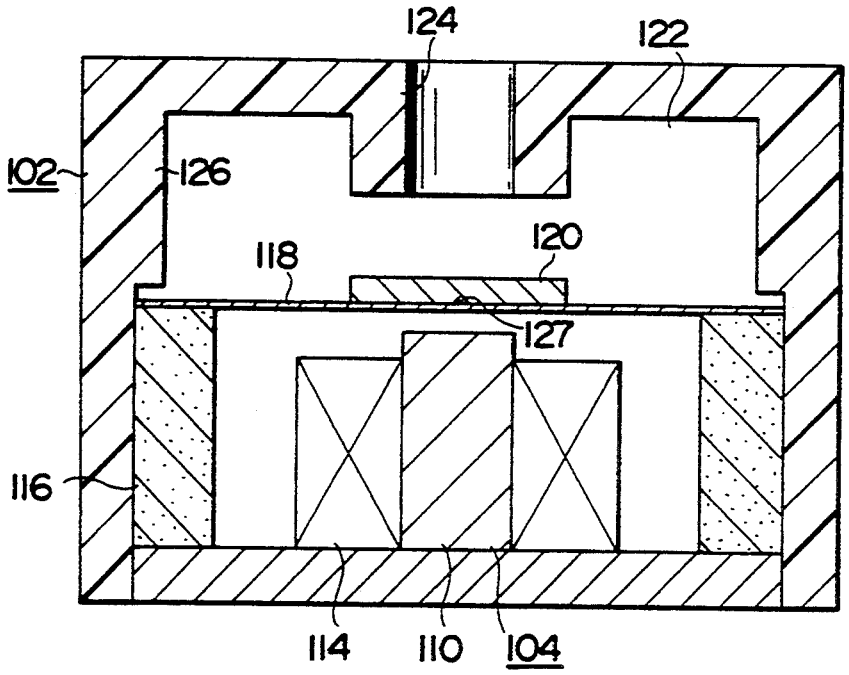
PRIOR ART FIG. 19
FIG. 19 is a cross-sectional view of the electroacoustic transducer of FIG. 17 showing the stationary state of the diagram.
Figure 20:
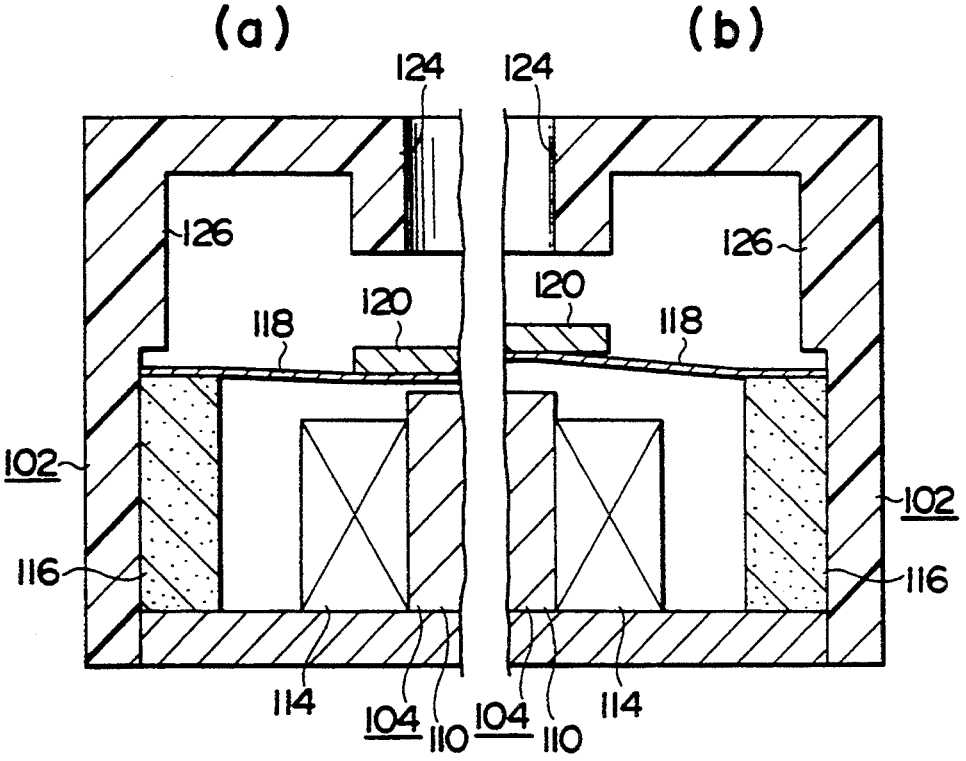
PRIOR ART FIG. 20
FIG. 20 is a cross-sectional view of the electroacoustic transducer of FIG. 17 showing the vibrating state of the diagram when it is normally driven.
Figure 21:
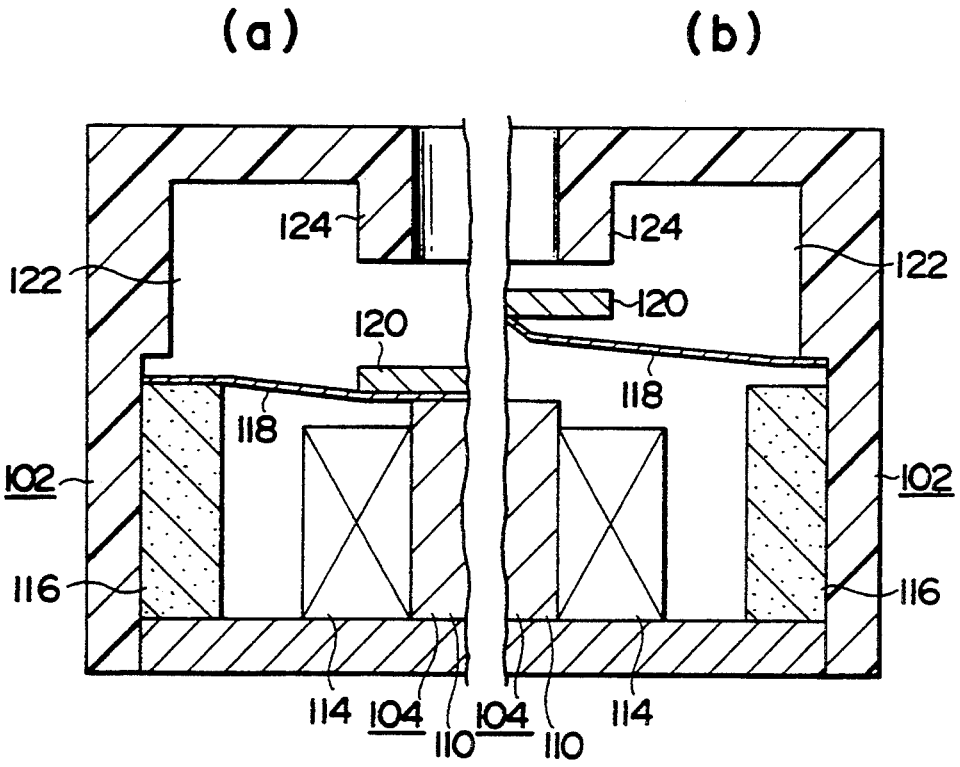
PRIOR ART FIG. 21
FIG. 21 is a cross-sectional view of the electroacoustic transducer of FIG. 17 showing the vibrating state of the diagram when an external force is applied to the electroacoustic transducer of FIG. 17.

Input terminals for applying an electric signal, not shown, are formed in the magnetic driving portion 4 like the input terminals 106 and 108 as illustrated in FIG. 17. A columnar core 10 is disposed at the center of the magnetic driving portion 4 and a coil 14 is wound around the core 10 by way of a bobbin 112, not shown, like the prior art electroacoustic transducer as illustrated in FIG. 17. The coil 14 is energized in response to the input electric signal through the input terminals like the prior art electroacoustic transducer as illustrated in FIG. 17. A cylindrical magnet 16 is disposed about the coil 14 and constitutes a closed magnetic circuit with the core 10, the diaphragm 18 and a magnetic piece 20. The magnetic piece 20 is fixed to the diaphragm 18 at a welded portion 27. The magnetic piece 20 has, like the prior art electroacoustic transducer, a close magnetic relation with the core 10 and adds mass to the diaphragm 18.

In this first embodiment, there is formed a movement restricting means for restricting the movement of the diaphragm 18 within an allowable moving range at the side of the magnetic piece 20 disposed at one side (upper side in FIG. 1) of the diaphragm 18, i.e. at the center of the diaphragm 18. That is, the sound emitting cylinder 24 is designed so long that an interval D between the magnetic piece 20 and itself may be equal to or slightly greater than an ordinary allowable moving range.

With such an arrangement, even if the diaphragm 18 moves away from the magnet 16 and moves upward when a strong shock is applied to the electroacoustic transducer, the magnetic piece 20 strikes against the end surface of the sound emitting cylinder 24 so that the diaphragm 18 is prevented from moving excessively as illustrated in FIG. 2. Furthermore, since the movement restriction is performed at the magnetic piece 20, namely, at the center of the diaphragm 18, the influence of the peeling force which was conventionally generated between the diaphragm 18 and the magnetic piece 20 can be removed completely, which enhances the reliability of the electroacoustic transducer.

Figure 3:
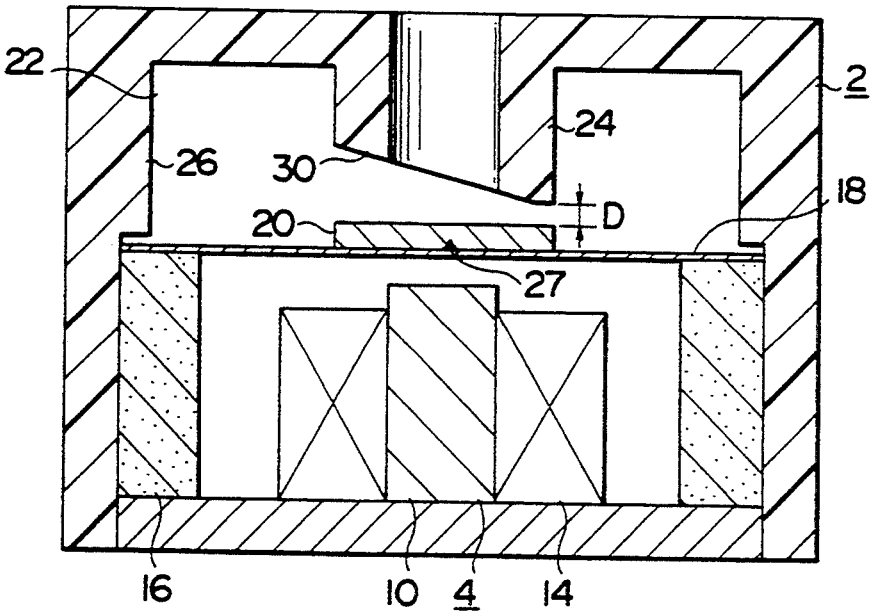
FIG. 3 is a longitudinal cross-sectional view of an electroacoustic transducer according to a second embodiment of the invention.
Figure 4:
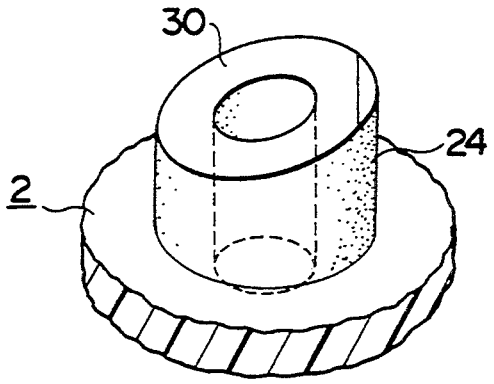
FIG. 4 is a perspective view showing a sound emitting cylinder portion of the electroacoustic transducer of FIG. 3.

Second Embodiment (FIGS. 3 and 4):

FIGS. 3 and 4 show the electroacoustic transducer according to the second embodiment of the invention. In this embodiment, the sound emitting cylinder 24 of the first embodiment has an incline surface 30 at its end.

With such an arrangement, the average interval between the sound emitting cylinder 24 and the diaphragm 18 can be increased while the interval D for the free movement of the diaphragm 18 is maintained like the first embodiment. As a result, the front surface of the diaphragm 18 can be sufficiently open on the side thereof facing the resonant chamber 22 while the moving range of the diaphragm 18 is restricted, which enhances the acoustic characteristics.

Figure 5:
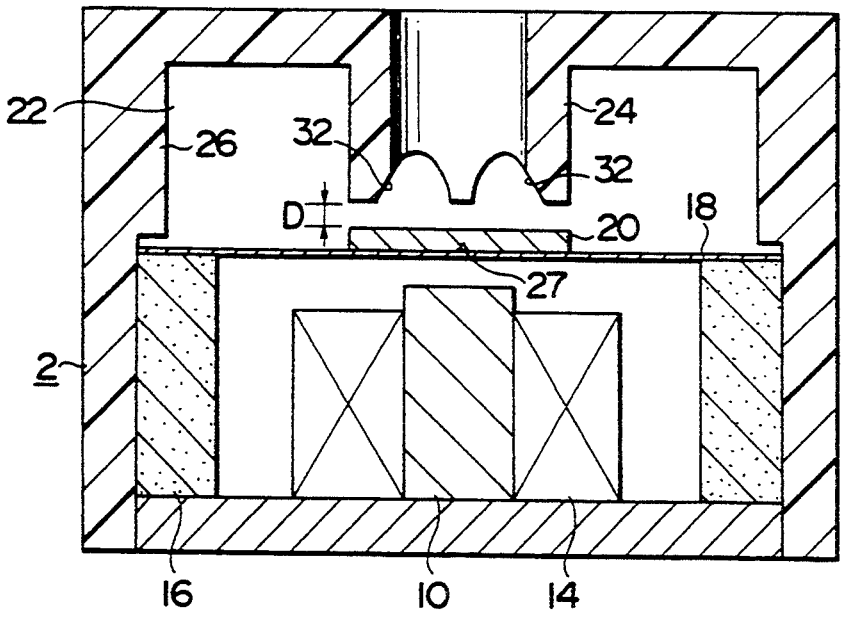
FIG. 5 is a longitudinal cross-sectional view of an electroacoustic transducer according to a third embodiment of the invention.
Figure 6:
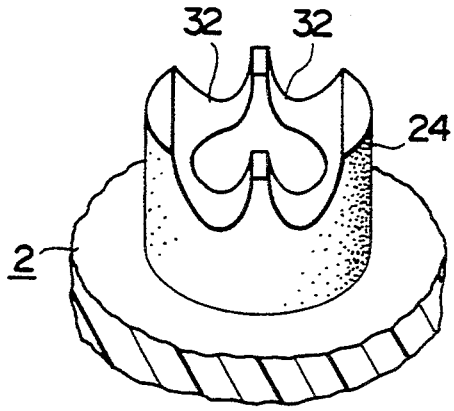
FIG. 6 is a perspective view showing a sound emitting cylinder portion of the electroacoustic transducer of FIG. 5.

Third Embodiment (FIGS. 5 and 6)

FIGS. 5 and 6 show the electroacoustic transducer according to the third embodiment of the invention. In this embodiment, a plurality of U-shaped notches 32 are formed at an end surface of the sound emitting cylinder 24.

With such an arrangement, the average interval between the sound emitting cylinder 24 and the diaphragm 18 can be increased while the interval D for the free movement of the diaphragm 18 is maintained like the first embodiment. As a result, the front surface of the diaphragm 18 can be sufficiently open on the side thereof facing the resonant chamber 22 while the moving range of the diaphragm 18 is restricted, which advantages the acoustic characteristics.

Figure 7:
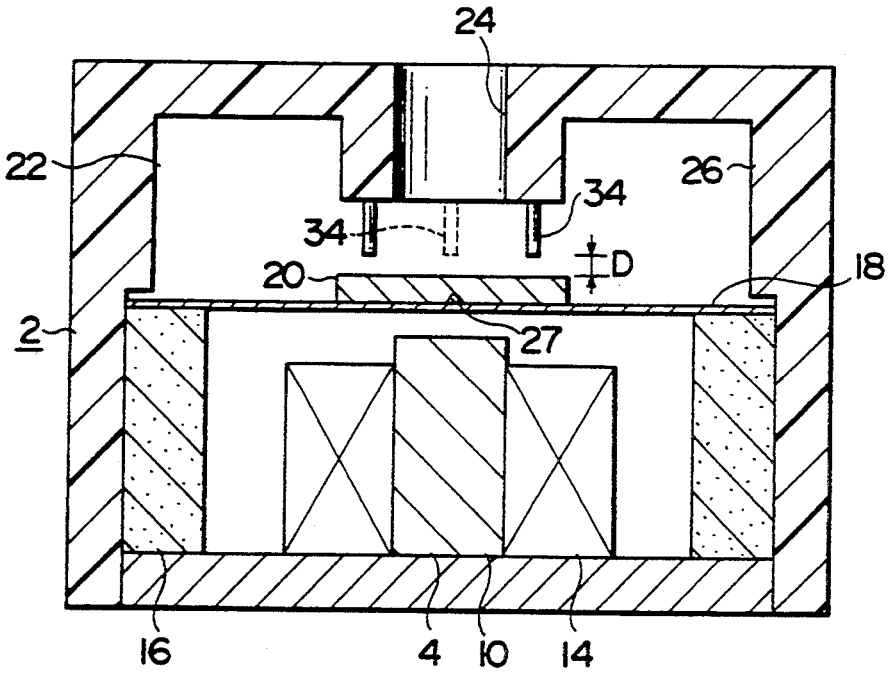
FIG. 7 is a longitudinal cross-sectional view of an electroacoustic transducer according to a fourth embodiment of the invention.
Figure 8:
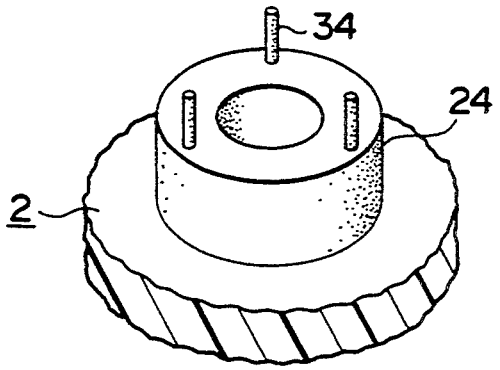
FIG. 8 is a perspective view showing a sound emitting cylinder portion of the electroacoustic transducer of FIG. 7.

Fourth Embodiment (FIGS. 7 and 8)

FIGS. 7 and 8 show the electroacoustic transducer according to the fourth embodiment of the invention. In this embodiment, the length of the sound emitting cylinder 24 of the first embodiment is the same as the prior art and a plurality of thin columnar projections 34 serving as a movement restricting means of the diaphragm 18 are formed on an end surface of the sound emitting cylinder 24. The projections 34 are disposed at equal angular intervals of 120° to restrict the movement of the diaphragm 18 on the average at the center of the diaphragm 18, i.e. at the magnetic piece 20 as illustrated in FIG. 8.

With such an arrangement, the movement of the diaphragm 18 due to the application of an external force such as a shock can be restricted and the front surface of the diaphragm 18 can be sufficiently open on the side thereof facing the resonant chamber 22 and also the movement restricting means does not impede the acoustic characteristics.

Figure 9:
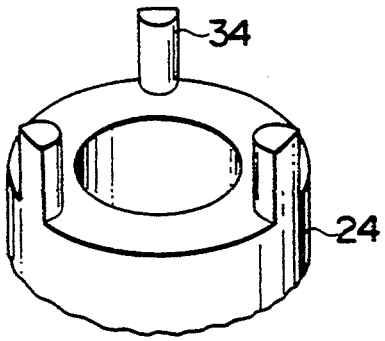
FIG. 9 is a perspective view of a sound emitting cylinder portion of an electroacoustic transducer according to a fifth embodiment of the invention.
Figure 10:
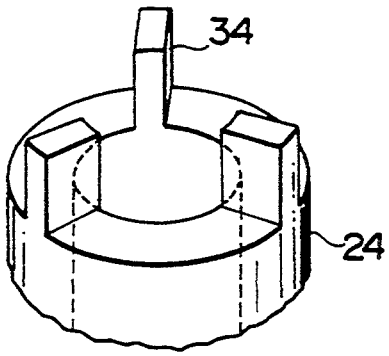
FIG. 10 is a perspective view showing a modification of the sound emitting cylinder portion of the electroacoustic transducer of FIG. 9.

Fifth Embodiment (FIGS. 9 and 10)

FIGS. 9 and 10 show the electroacoustic transducer according to the fifth embodiment of the invention. In this embodiment, a plurality of semicolumnar projections 34 are formed on the sound emitting cylinder 24 by extending portions of the outer peripheral surface of the sound emitting cylinder 24 as illustrated in FIG. 9, or a plurality of projections 34 each having the shape of a square pillar are formed on the sound emitting cylinder 24 by extending portions of the wall of the sound emitting cylinder 24 as illustrated in FIG. 10.

Figure 11:
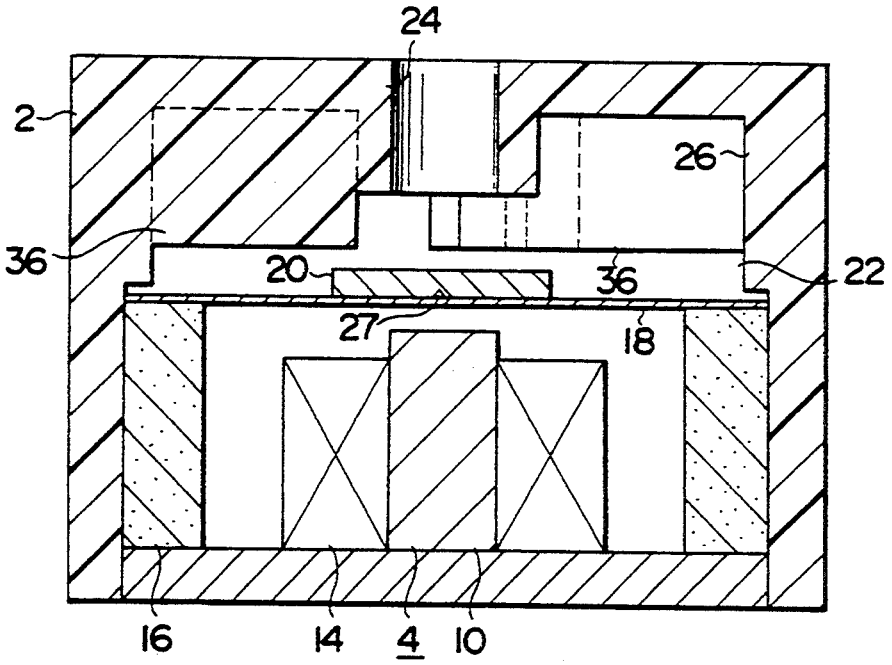
FIG. 11 is a longitudinal cross-sectional view of an electroacoustic transducer according to a sixth embodiment of the invention.
Figure 12:
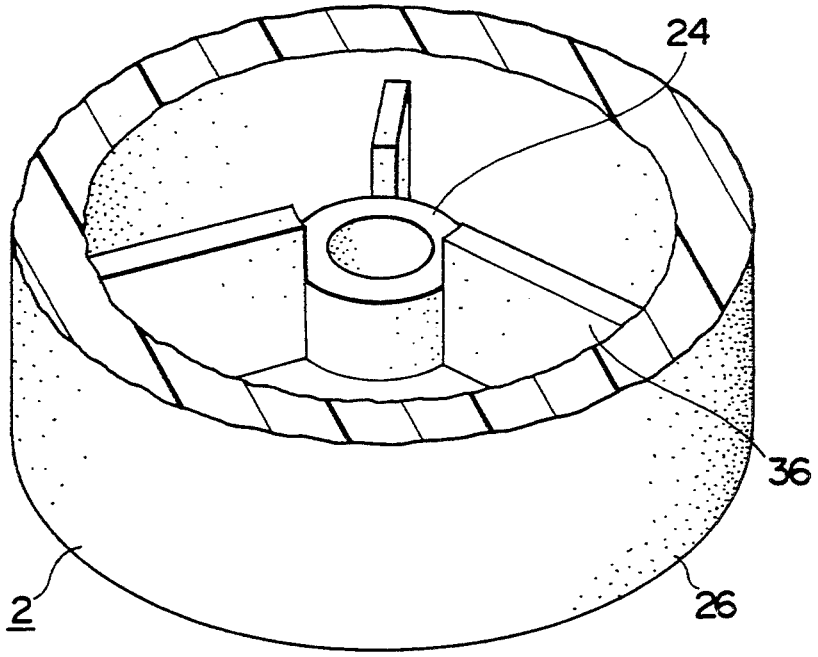
FIG. 12 is a perspective view showing a sound emitting cylinder and projections viewed from the inner side of an outer casing of the electroacoustic transducer of FIG. 11.

Sixth Embodiment (FIGS. 11 and 12)

FIGS. 11 and 12 show the electroacoustic transducer according to the sixth embodiment of the invention. In this embodiment, a plurality of plate-like projections 36 which serve as the movement restricting means of the diaphragm 18 are radially extended in the resonant chamber 22 from the sound emitting cylinder 24. That is, each projection 36 constituting a wall plate for dividing the resonant chamber 22 are disposed at equal angular intervals of 120° about the sound emitting cylinder 24 to restrict the movement of the diaphragm 18 on the average at the center of the diaphragm 18, i.e. at the magnetic piece 20. The upper surfaces of the projections 36 are higher than the end surface of the sound emitting cylinder 24.

With such projections 36, the same functions and effects as the first to fifth embodiments can be expected too.

Figure 13:
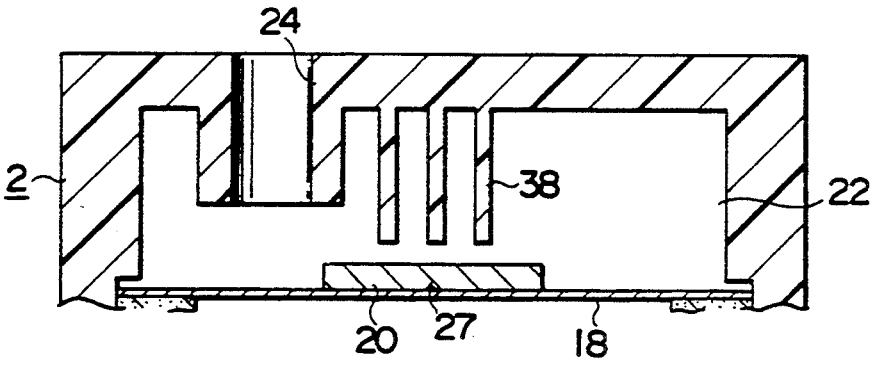
FIG. 13 is a longitudinal cross-sectional view of an electroacoustic transducer according to a seventh embodiment of the invention.
Figure 14:
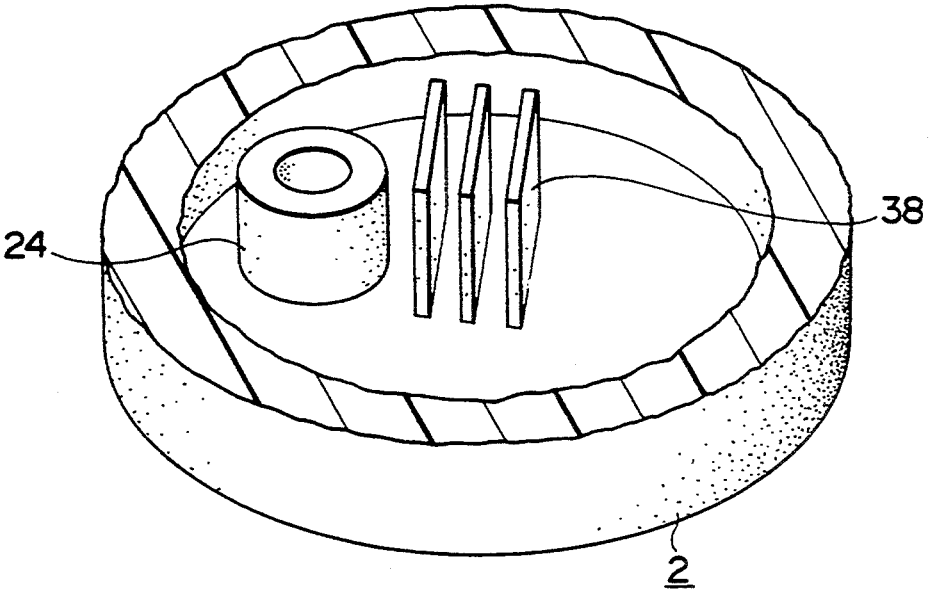
FIG. 14 is a perspective view showing a sound emitting cylinder viewed from the inner side of an outer casing of the electroacoustic transducer of FIG. 13.

Seventh Embodiment (FIGS. 13 and 14)

FIGS. 13 and 14 show the electroacoustic transducer according to the seventh embodiment of the invention. In this embodiment, the sound emitting cylinder 24 in the outer casing 2 is displaced in its position and a plurality of projections 38 are formed on the ceiling surface of the resonant chamber 22 at the center thereof.

Since the projections 38 serving as a protecting means of the diaphragm 18 are disposed at the center of the resonant chamber 22 and the sound emitting cylinder 24 is displaced therefrom, a resonant sound in the resonant chamber 22 due to the vibration of the diaphragm 18 can be effectively emitted to the atmosphere.

Figure 15:
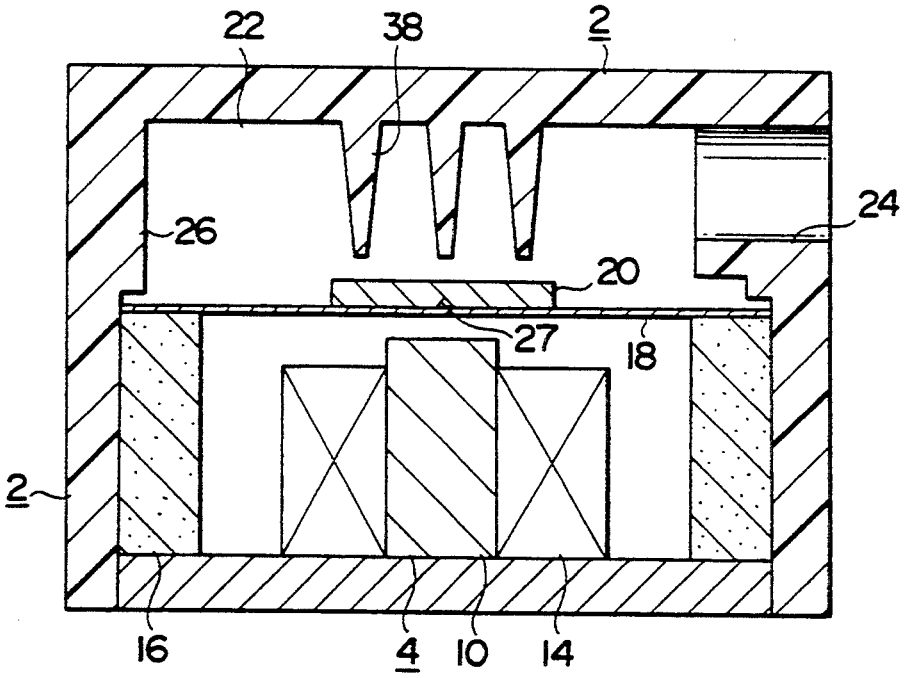
FIG. 15 is a longitudinal cross-sectional view of an electroacoustic transducer according to an eighth embodiment of the invention.
Figure 16:
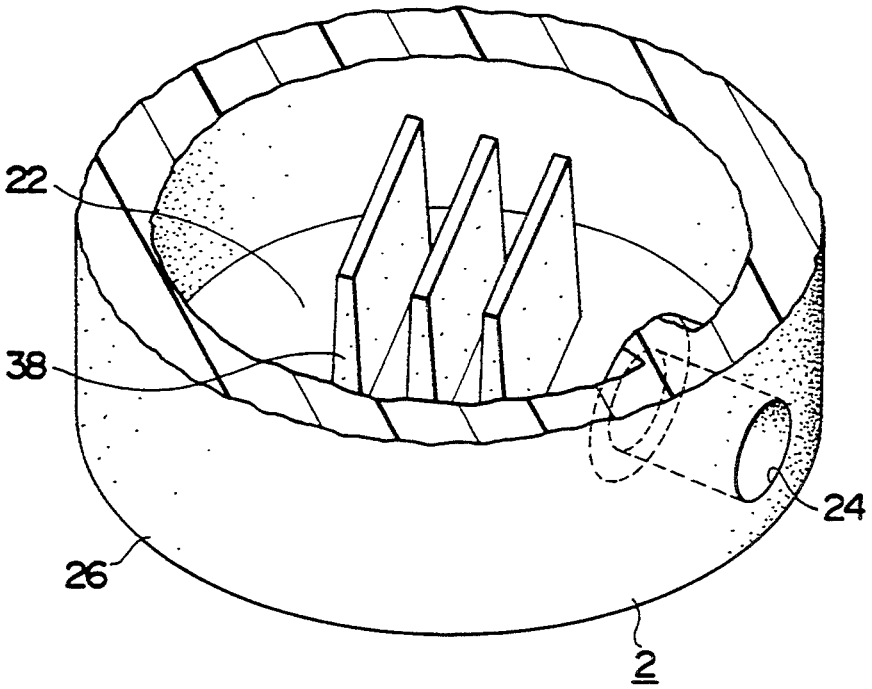
FIG. 16 is a perspective view showing a sound emitting cylinder viewed from the inner side of an outer casing of the electroacoustic transducer of FIG. 15.

Eighth Embodiment (FIGS. 15 and 16)

FIGS. 15 and 16 show the electroacoustic transducer according to the eighth embodiment of the invention. In this embodiment, the sound emitting cylinder 24 is formed on the side wall of the outer casing 2 and a plurality of plate-like projections 38 are formed on the ceiling surface of the resonant chamber 22 at the center thereof. Each projection 38 may be a columnar body.

With such an arrangement, the diaphragm 18 can be protected at the magnetic piece 20 against the damage or injure caused by its excessive movement and a resonant sound in the resonant chamber 22 can be emitted from the side surface of the outer casing 2.

Although the features of the invention have been described with reference to the first to eighth embodiments, the electroacoustic transducer of the invention is not limited to those embodiments, it is to be understood that the invention includes many variations and changes having the same effects as the first to eighth embodiments.

What is claimed is:

1. An electroacoustic transducer for converting an electric signal applied thereto into sound, comprising:

a cylindrical outer casing;

a magnetic diaphragm coaxial with the casing and disposed in a middle portion of the outer casing;

the diaphragm having a magnetic member fixed to one side of a central portion of the diaphragm for adding mass thereto;

a resonant chamber formed inside the outer casing at a front end of the diaphragm;

a sound emitting passageway connecting the resonant chamber to the atmosphere;

magnetic driving means disposed at the other side of the diaphragm for inducing magnetic vibration in the diaphragm in response to the electric signal, the magnetic driving means including (a) a core;

(b) a coil wound around the core and energized by the electric signal; and (c) a magnet which is disposed around the coil to generate a magnetic field passing through the diaphragm and magnetic member;

means for restricting the movement range of the diaphragm located inside the resonant chamber of the outer casing and confronting the magnetic member;

the restriction means having a surface for contracting the magnetic member upon deflection of the diaphragm beyond a preseletected amount thereby restricting the diaphragm movement.

2. An electroacoustic transducer according to claim 1, wherein the sound emitting passageway is a tubular cylinder.

3. An electroacoustic transducer according to claim 2, wherein the restriction means comprises a plurality of projections formed on an end surface of the sound emitting cylinder and projecting toward the magnetic member of the diaphragm.

4. An electroacoustic transducer according to claim 2, wherein the cylinder is integrally formed with an interior end wall of the casing and extends toward the magnetic member of the diaphragm.

5. An electroacoustic transducer according to claim 2, wherein the restriction means comprises plate-shaped bodies extending radially outward from the sound emitting cylinder and projecting axially inward beyond the sound emitting cylinder.

6. An electroacoustic transducer according to claim 2, wherein the restriction means comprises a plurality of centrally located projections disposed in the resonant chamber and confronting the magnetic member of the diaphragm, the sound emitting cylinder offset from the center of the outer casing.

7. An electroacoustic transducer according to claim 2, wherein the sound emitting passageway is an opening formed in the wall of the casing.

8. An electroacoustic transducer according to claim 3, wherein the projections confronting the magnetic member of the diaphragm are rectangular.

9. An electroacoustic transducer according to claim 3, wherein the projections are columnar bodies.

10. An electroacoustic transducer according to claim 4, wherein the sound emitting cylinder has an inclined surface confronting the magnetic member of the diaphragm.

11. An electroacoustic transducer according to claim 4, wherein the sound emitting cylinder has a surface having notches confronting the magnetic member of the diaphragm.

12. An electroacoustic transducer according to claim 9, wherein the columnar body has a semi-circular cross section.

* * * * *